US008550696B2

(12) United States Patent
Ebers et al.

(10) Patent No.: US 8,550,696 B2
(45) Date of Patent: Oct. 8, 2013

(54) LABORATORY MIXER AND VORTEXER

(75) Inventors: Manfred Ebers, Bonningstedt (DE); Peter Schmidt, Lubeck (DE)

(73) Assignee: Eppendorf AG, Hamburg (DE)

( * ) Notice: Subject to any disclaimer, the term of this patent is extended or adjusted under 35 U.S.C. 154(b) by 903 days.

(21) Appl. No.: 11/682,476

(22) Filed: Mar. 6, 2007

(65) Prior Publication Data

US 2007/0212265 A1 Sep. 13, 2007

(30) Foreign Application Priority Data

Mar. 9, 2006 (DE) ..... 10 2006 011 371

(51) Int. Cl.
*B01F 11/00* (2006.01)

(52) U.S. Cl.
USPC ..... 366/209; 366/111

(58) Field of Classification Search
USPC ..... 366/220, 235, 108–128, 208–219; 435/286.7, 303.3
See application file for complete search history.

(56) References Cited

U.S. PATENT DOCUMENTS

| | | | | | |
|---|---|---|---|---|---|
| 856,619 | A | * | 6/1907 | Camp et al. | 366/214 |
| 1,745,327 | A | | 1/1930 | Snow | |
| 2,809,020 | A | * | 10/1957 | Magee et al. | 366/208 |
| 3,061,280 | A | * | 10/1962 | Kraft et al. | 366/110 |
| 3,159,384 | A | * | 12/1964 | Davis | 366/110 |
| 3,163,404 | A | * | 12/1964 | Kraft et al. | 366/214 |
| 3,430,926 | A | * | 3/1969 | Liobis et al. | 366/212 |
| 3,601,372 | A | * | 8/1971 | Harmes | 366/219 |
| 3,778,033 | A | * | 12/1973 | Pullman | 366/219 |
| 3,850,580 | A | * | 11/1974 | Moore et al. | 422/99 |
| 3,975,001 | A | * | 8/1976 | Moore et al. | 366/111 |
| 4,061,315 | A | * | 12/1977 | Eitzen et al. | 366/111 |
| 4,118,801 | A | * | 10/1978 | Kraft et al. | 366/111 |
| 4,202,634 | A | | 5/1980 | Kraft et al. | |
| 4,305,668 | A | * | 12/1981 | Bilbrey | 366/111 |
| 4,345,843 | A | * | 8/1982 | Berglund et al. | 366/219 |
| 4,555,183 | A | * | 11/1985 | Thomas | 366/208 |
| 4,610,546 | A | | 9/1986 | Intraub | |

(Continued)

FOREIGN PATENT DOCUMENTS

| | | |
|---|---|---|
| DE | 1597016 | 8/1970 |
| DE | 32 20 879 C2 | 9/1989 |

(Continued)

OTHER PUBLICATIONS

Machine translation (EPO) of DE 4419480, generated Jul. 27, 2010.*

(Continued)

*Primary Examiner* — Charles E Cooley
(74) *Attorney, Agent, or Firm* — White & Case LLP

(57) ABSTRACT

Disclosed is an apparatus for mixing laboratory vessel contents. The apparatus has an accommodating adapter with a holder for accommodating laboratory vessels, e.g., laboratory vessels in an exchangeable block module, and a drive for putting the accommodating adapter into a mixing movement which essentially oscillates in a circular and translatory manner in a horizontal plane. The accommodating adapter has a vortex adapter which is accessible from the outside and has a shoulder structure on a circumference. The shoulder structure has at least one shoulder which points toward the center of the circumference and is intended to drive a vessel, e.g., a test tube, which is held and placed from the outside, into the mixing movement in a form-fitting manner.

19 Claims, 3 Drawing Sheets

(56) References Cited

U.S. PATENT DOCUMENTS

| | | | | | |
|---|---|---|---|---|---|
| 4,628,729 | A | | 12/1986 | Thoone | |
| 4,673,297 | A | | 6/1987 | Siczek et al. | |
| 4,679,615 | A | | 7/1987 | Livne | |
| 4,747,693 | A | * | 5/1988 | Kahl | 366/208 |
| 4,750,845 | A | * | 6/1988 | Nabetani | 366/208 |
| 4,848,917 | A | * | 7/1989 | Benin et al. | 366/208 |
| 4,883,644 | A | * | 11/1989 | Perlman | 422/562 |
| 4,943,164 | A | * | 7/1990 | Ohishi et al. | 366/149 |
| 5,060,151 | A | | 10/1991 | Mikyska et al. | |
| 5,195,825 | A | * | 3/1993 | Ringrose | 366/213 |
| 5,259,672 | A | | 11/1993 | Rowe | |
| 5,372,425 | A | * | 12/1994 | Tannenbaum et al. | 366/208 |
| 5,375,927 | A | | 12/1994 | Hermsen et al. | |
| 5,427,451 | A | | 6/1995 | Schmidt | |
| 5,592,289 | A | | 1/1997 | Norris | |
| 5,593,228 | A | * | 1/1997 | Tannenbaum | 366/209 |
| 5,641,229 | A | * | 6/1997 | McClintock et al. | 366/208 |
| 5,668,318 | A | | 9/1997 | Okada | |
| 5,795,061 | A | * | 8/1998 | Perlman | 366/130 |
| 5,813,759 | A | * | 9/1998 | Gebrian | 366/208 |
| 5,904,421 | A | | 5/1999 | Mazzalveri | |
| 5,918,979 | A | * | 7/1999 | Martin et al. | 366/211 |
| 6,039,557 | A | * | 3/2000 | Unger et al. | 425/429 |
| 6,310,685 | B1 | | 10/2001 | Baan et al. | |
| 6,416,719 | B1 | | 7/2002 | Fawcett et al. | |
| 6,514,465 | B2 | | 2/2003 | Steiner | |
| 6,579,002 | B1 | | 6/2003 | Bartick et al. | |
| 6,709,148 | B2 | * | 3/2004 | Glass | 366/110 |
| 6,823,735 | B2 | | 11/2004 | Ishikawa et al. | |
| 7,005,617 | B2 | | 2/2006 | Brown | |
| 7,270,472 | B2 | | 9/2007 | Carreras | |
| 7,296,923 | B1 | | 11/2007 | Malasky et al. | |
| 7,296,924 | B2 | * | 11/2007 | Czarnek | 366/208 |
| D569,988 | S | * | 5/2008 | Koop | D24/220 |
| 7,575,363 | B2 | * | 8/2009 | Ruser et al. | 366/140 |
| 7,654,729 | B2 | * | 2/2010 | Passoni | 366/208 |
| 8,016,478 | B2 | * | 9/2011 | Ebers et al. | 366/208 |
| 8,317,389 | B2 | * | 11/2012 | Jagle | 366/208 |
| 8,393,781 | B2 | * | 3/2013 | Manera et al. | 366/112 |
| 2002/0118594 | A1 | * | 8/2002 | Vellinger et al. | 366/116 |
| 2004/0013576 | A1 | * | 1/2004 | Gfrorer et al. | 422/104 |
| 2004/0151064 | A1 | * | 8/2004 | Yi | 366/209 |
| 2006/0187743 | A1 | | 8/2006 | Carreras | |
| 2007/0125186 | A1 | * | 6/2007 | Ruser et al. | 73/863.01 |
| 2007/0177457 | A1 | * | 8/2007 | Hafner | 366/208 |
| 2007/0211566 | A1 | * | 9/2007 | Ebers et al. | 366/208 |
| 2007/0212265 | A1 | * | 9/2007 | Ebers et al. | 422/99 |
| 2008/0298162 | A1 | * | 12/2008 | Passoni | 366/111 |
| 2010/0034048 | A1 | * | 2/2010 | Jagle | 366/118 |
| 2010/0143197 | A1 | * | 6/2010 | Link et al. | 422/104 |
| 2010/0284238 | A1 | * | 11/2010 | Ebers et al. | 366/110 |

FOREIGN PATENT DOCUMENTS

| | | | | |
|---|---|---|---|---|
| DE | 900 42 23 | U1 | | 8/1990 |
| DE | 4012902 | C1 | | 4/1991 |
| DE | 4419480 | | * | 7/1995 |
| DE | 19652152 | C2 | | 11/1998 |
| DE | 200 18 633 | | | 2/2001 |
| DE | 202 12 722 | | | 11/2002 |
| DE | 101 34 702 | A1 | | 2/2003 |
| DE | 102 28 431 | B4 | | 1/2004 |
| DE | 202004008470 | | | 9/2004 |
| DE | 10 2004 021 664 | A1 | | 12/2005 |
| DE | 10 2005 035 335 | | | 2/2007 |
| DE | 102007010616 | A1 | * | 9/2008 |
| EP | 356883 | A1 | * | 3/1990 |
| EP | 0 694 785 | | | 1/1996 |
| EP | 0 711 603 | A1 | | 5/1996 |
| EP | 1 393 797 | A2 | | 3/2004 |
| EP | 1 595 593 | A1 | | 5/2004 |
| EP | 1 201 297 | A1 | | 12/2004 |
| EP | 1 795 256 | | | 6/2007 |
| EP | 2292323 | A1 | * | 3/2011 |
| GB | 2146252 | A | * | 4/1985 |
| JP | 63-115432 | | | 5/1988 |
| JP | 05-013532 | | | 1/1993 |
| JP | 10-005569 | | | 1/1998 |
| JP | 2002-318236 | | | 10/2002 |
| JP | 2004255222 | | | 9/2004 |
| JP | 20055168345 | | | 6/2005 |
| JP | 2007-530272 | | | 11/2007 |
| JP | 2007-536080 | | | 12/2007 |
| JP | 08-052336 | | | 3/2008 |
| WO | 95/04591 | A1 | | 2/1995 |
| WO | WO 9831457 | A1 | * | 7/1998 |
| WO | WO 2005/094977 | A1 | | 10/2005 |
| WO | WO 2005107931 | A1 | * | 11/2005 |
| WO | WO 2007/012437 | A | | 2/2007 |
| WO | 2010/123205 | A2 | * | 10/2010 |

OTHER PUBLICATIONS

Exchangeable Thermoblocks for Thermomixers and Thermostats, Instructions for Use, Eppendorf AG, 2008.

Prospect: "Schüttel-und Mischgeräte" of Heidolph (1993), pp. 2-3.

Prospect: "Schüttel-und Mischgeräte, perfect mix" of Heidolph (1996), pp. 4-5.

Prospect: "Laboshake Schüttelmaschine", Gerhardt (2002), pp. 2-3.

* cited by examiner

LABORATORY MIXER AND VORTEXER

FIELD OF INVENTION

The present invention relates to an apparatus for mixing laboratory vessel contents, in particular, said apparatus having an accommodating adapter having a holder for accommodating vessels, in particular laboratory vessels in exchangeable block modules, and a drive which can be used to put the accommodating adapter into a mixing movement which essentially oscillates in a circular and translatory manner in a horizontal plane.

BACKGROUND OF INVENTION

Mixing apparatuses in which vessel contents are mixed are sufficiently well known. For laboratories, in particular, there are mixers which can also mix small amounts of liquid by virtue of the fact that small containers are also combined in very large groups of tens, hundreds or even thousands in suitable holders, so-called "exchangeable block modules" (apparatuses which are intended to accommodate vessels and can also be used for temperature control). Such exchangeable block modules as well as the reaction vessels can be standardized. For example, there are reaction vessels having a content of 0.2 ml, 0.5 ml, 1.5 ml and 2.0 ml—as well as respective suitable exchangeable block modules which are standardized for the latter. In addition, there are, for example, exchangeable block modules for cryo vessels, for Falcon vessels (1.5 ml and 50 ml), for glass vessels and glass beakers, for microtiter plates (MTP), for deep well plates (MVP), for slides and for PCR plates having 96 wells. This list is not exhaustive but indicates the wide variety of laboratory vessels which exist and for which the mixers should be suitable. For this purpose, there are standards and rules for the so-called "footprints"—namely the base structure of exchangeable block modules. ANSI SBS-1, SBS-2, SBS-3 or SBS-4 (as at 2004) shall be mentioned here by way of example.

Since these exchangeable block modules are, in principle, designed in such a manner that the individual vessels are inserted into them from above, a mixing movement which oscillates in a circular and translatory manner and essentially takes place in a horizontal plane has become established for the known mixers. For this purpose, in the known mixers, an electromotive imbalance drive is generally responsible for putting a "table" into this circular movement. To this end, said table is known to be mounted in a different manner: mounting in linear rolling bearings (so-called spherical bushes) in the two horizontal directions is known, for example, but film hinge mounting is also known. Alternatively, there is also electromagnetic mounting or mounting using piezoelements which can each likewise also be used as a drive. Such mixers are usually driven at a rotational frequency of 200 rpm to 1500 rpm. The frequency can generally be set.

Although, for the purpose of mixing the abovementioned various reaction vessels in exchangeable block modules, the known mixers are entirely suited to being used in a very versatile manner in order to mix very different reaction vessels, other vessels outside this geometric standard can only be mixed using other mixing apparatuses, which are respectively set up and suitable for this purpose, on account of the mock-up fastening needed to hold the exchangeable block modules. Therefore, there are also other appliances, in addition to a mixer of the described type, in most laboratories. For example, a so-called "vortexer," which grasps the bottom of a vessel that is manually held on the latter and drives it into a rotational movement so that a vortex forms in the liquid in the vessel and this liquid is mixed, is in widespread use.

SUMMARY OF THE INVENTION

The present invention is based on the object of providing a mixer of the type described initially which has a larger field of application.

This object is achieved by a mixing apparatus having the features as described and illustrated herein.

According to the invention, a mixing apparatus, in particular for laboratory vessel contents, is provided with an accommodating adapter and a drive. The accommodating adapter has a holder which is suitable for accommodating vessels. This is preferably intended to mean that the vessels can be introduced into the holder of the accommodating adapter in such a manner that they are not released by themselves during undisturbed operation during the mixing movement into which the accommodating adapter can be put using the drive. The holder of the accommodating adapter preferably meets particular standards, in particular for laboratory vessels in exchangeable block modules.

The drive of the inventive mixing apparatus is capable of putting the accommodating adapter into a mixing movement which essentially oscillates in a circular and translatory manner in a plane. In other words, such an inventive mixing movement can be described by the fact that two (imaginary) points of the accommodating adapter execute a circular movement with essentially the same angular position, the same angular speed and the same radius. The mixing movement preferably takes place in a horizontal plane, with the result that an exchangeable block modules which is accommodated in said adapter is mixed with its reaction vessels upright.

The inventive mixing apparatus is distinguished by the fact that the accommodating adapter has a vortex structure, a vortex adapter, which is accessible from the outside. The latter is suitable for driving a vessel, in particular a test tube, which is held and placed from the outside, into the mixing movement in a form-fitting manner. To this end, the vortex adapter has a shoulder structure. The latter is arranged on a (possibly also only imaginary) circumference and has at least one shoulder which points toward the center of the circumference. The vortex adapter may thus have, for example, a cavity whose edge constitutes the inventive "circumference" with the inventive "center" in the middle of the cavity. In this case, the edge of the cavity forms, as it were, a single shoulder which rotates on the circumference.

Alternatively or cumulatively, the vortex adapter may also have at least three radial flanks which fall toward the center and are preferably uniformly arranged on the circumference. Three such flanks are then preferably arranged at an angle of 120° with respect to one another, four such flanks are arranged at an angle of 90° with respect to one another and so on.

Alternatively or cumulatively, the vortex adapter may also have an elastic surface which can be pressed in to form a cavity by a vessel which is held on the latter using a certain pressure force.

According to the invention, these possible ways of providing the inventive vortex structure assist the reliable driving of a vessel, which is held on the structure, into the mixing movement.

In order to assist this effect further, the vortex adapter may have a surface which is even only slightly elastic and/or a surface which adheres to smooth surfaces. Such a surface which is possible according to the invention preferably adheres to glass, in particular, since test tubes or mixing flasks commonly comprise this material or a plastic which has a similar nature and for which the surface may preferably also be suitable. This elastic surface preferably comprises elastomer, vulcanized rubber, unvulcanized rubber, neoprene or the like—each of which may possibly also be coated.

Overall, the inventive apparatus may advantageously be used both as a mixer and as a vortexer without having to provide two appliances and, in particular, without even having to exchange any adapter on the apparatus.

According to the invention, the drive of the mixing apparatus should preferably be set in such a manner that a frequency of the mixing movement in the range of more than 2000 rpm and even more than 3000 rpm results. The radius of the mixing apparatus is preferably less than 3 cm or even less than 2 cm, to name suitable mixing movement parameters for vortexing by way of example. However, it is particularly preferable to configure the mixing movement frequency and even the radius of the mixing movement as well in such a manner that they can be set in a variable manner. Mixing programs which are particularly suited, in a first situation, to mixing an exchangeable block modules which has been inserted and has reaction vessels and, immediately afterward, are particularly suited to vortexing a test tube in a next situation can thus also be run, for example, using a programmable controller of the inventive mixer.

Varying the rotational speed and the travel results in particularly advantageous mixing properties for various different mixing tasks, which mixing properties cannot be achieved by varying only one mixing parameter. For example, in typical applications for the dissolution behavior of solids in the pharmaceutical sector, a respective particular rotational speed/travel ratio is optimal, namely, for example, when dissolving tablets while supplying a large amount of energy. Alternatively, centrifugation or vacuum concentration products are processed further in the laboratory in the form of pellets. In this case, rapid and complete resuspension—while advantageously being able to set the frequency and travel—plays an important role. On the other hand, particularly gentle treatment of the material that has been introduced—again while advantageously being able to set the frequency and travel—must be considered in the case of so-called soft vortexing. For example, particular DNA chains may thus be changed to an undesirable state as a result of too much energy being supplied, which state may adversely affect further processing. Other possible uses of a controllable energy supply by combining the rotational speed and travel in a manner which can be optimized result, for example, for adaptive comminution of substances using media which have been introduced, for example spherical particles, and ensure optimum force transmission to soft substances as well, for example.

In another aspect of the present invention, a mixing apparatus of the generic type is distinguished by the fact that the holder has at least one spring clamping means which holds an accommodated vessel, in particular an accommodated exchangeable block modules, in a force-fitting and frictional manner. In this case, the holder is preferably not actually form-fitting and, in particular, does not have an additional notch and an additional locking element as mechanical form-fitting elements. This makes the inventive holder particularly suitable for automatic machines—but not least also for daily manual insertion where, despite perhaps occasionally diminishing concentration during positioning, an exchangeable block modules having the vessel contents to be mixed must ultimately be inserted into the mixing apparatus in a reliable manner and in an accurate position. Automatic laboratory machines are known, for example, to enable rapid and reproducible pipetting and dispensing operations. In this case, charging sequences which are otherwise carried out manually are carried out, for example, using an arm which is driven by a motor and has corresponding metering tools. The arm may move in all three spatial axes. Particularly precise positioning of the plates and vessels is very advantageous for precise metering. This also applies to accessories which are intended to be used together with such automatic machines, for example also to a mixer of the inventive type which can be automatically fitted with vessels and exchangeable block modules by such an automatic laboratory machine.

Other advantages and features of the inventive apparatus are described with reference to FIG. 1, which illustrates one exemplary embodiment of the inventive mixing apparatus.

DETAILED DESCRIPTION OF DRAWINGS

Figure 1:
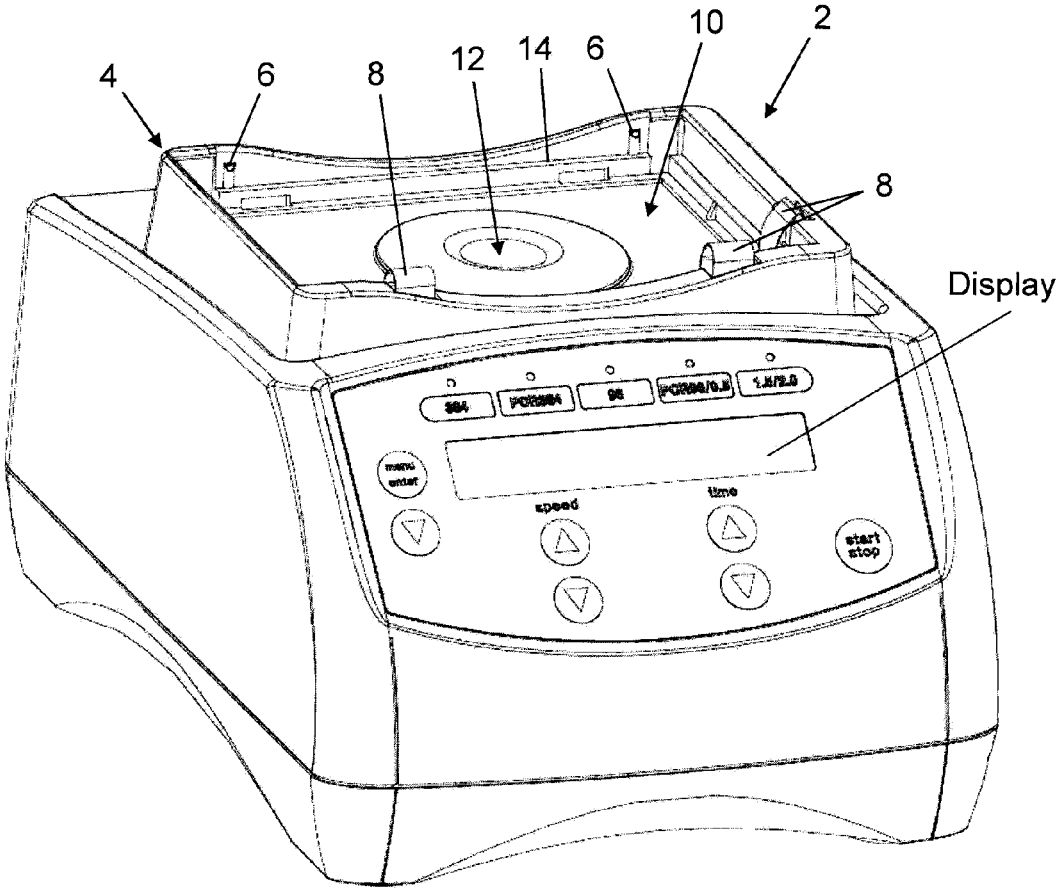
FIG. 1 shows a three-dimensional view of an inventive mixing apparatus.
Figure 2:
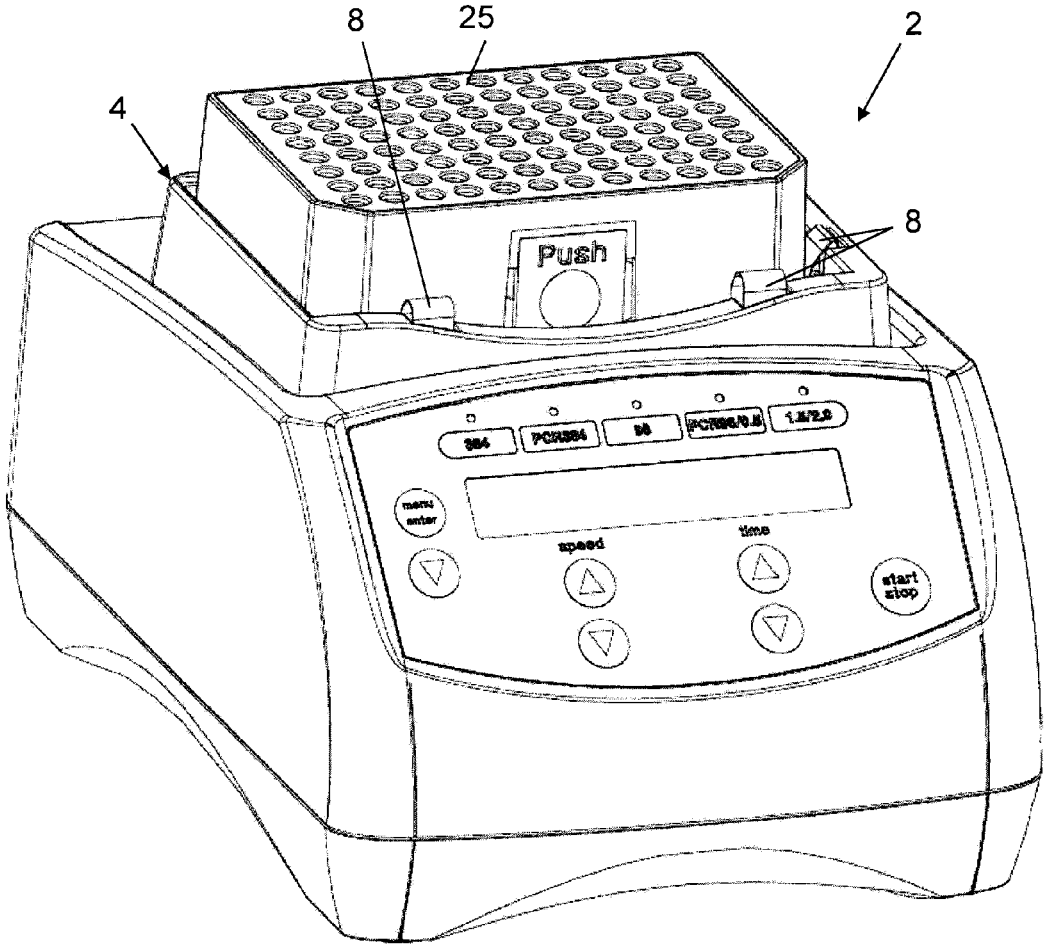
FIG. 2 shows an exchangeable block module positioned within the frame of the accommodating adapter of the inventive mixing apparatus.

With reference to FIGS. 1 and 2, mixing apparatus 2 has an accommodating adapter 4 which is on the top side, is in the form of a frame and has holders 6 and 8 for accommodating exchangeable block module 25.

Figure 3:
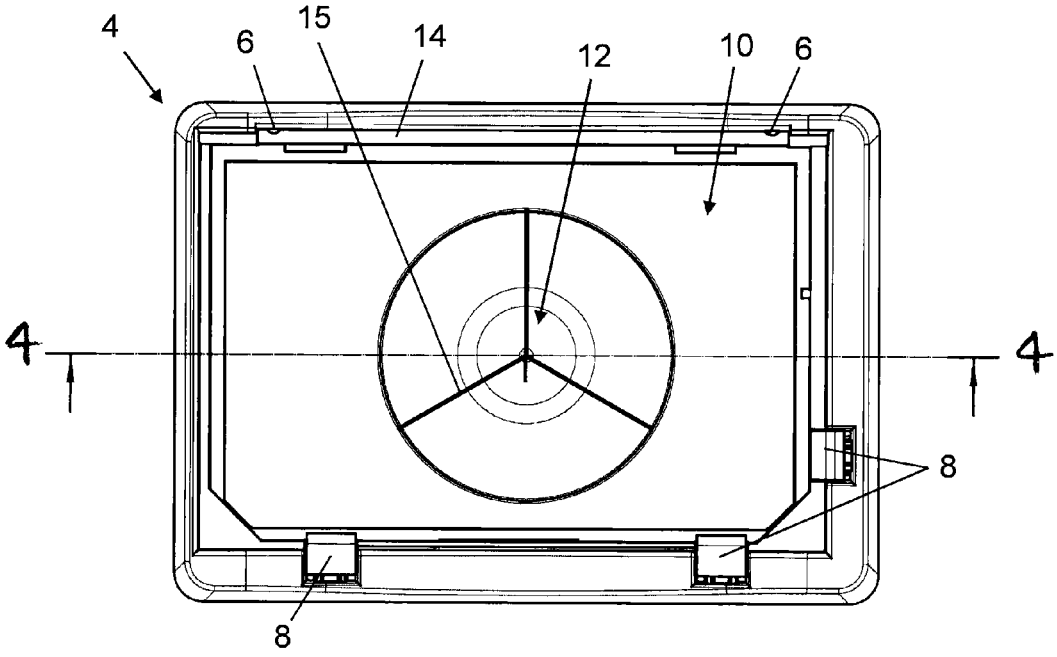
FIG. 3 provides a top view of the inventive mixing apparatus which includes a view of the accommodating adapter and vortex adapter having three radial flanks.
Figure 4:
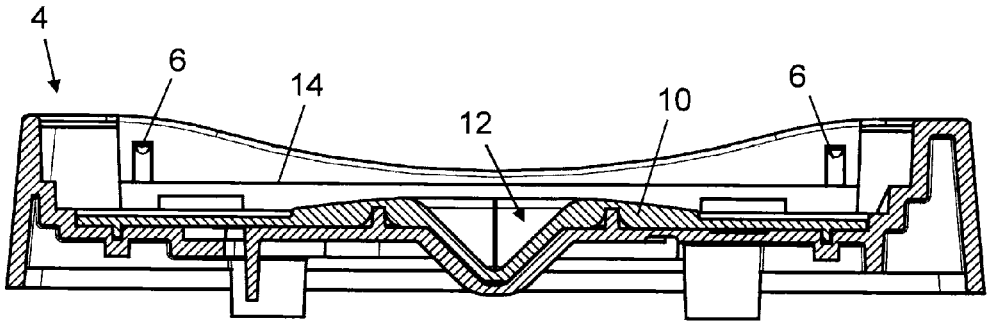
FIG. 4 is a side sectional view taken along line 4-4 of FIG. 3 of the accommodating adapter and vortex adapter of the inventive mixing apparatus.

As illustrated in FIGS. 1-3, accommodating adapter 4 holds the holding structures 6 and 8 in the form of a frame around an essentially rectangular interior which corresponds to the "footprint" of an exchangeable block module (not illustrated). This rectangular region is covered by a rectangular mat 10 which has, in its center, a cavity 12 having a wall-like edge elevation. The mat 10 can be removed for cleaning and is injection-molded from EPDM or silicone rubber. According to one embodiment, the vortex adapter may also have at least three radial flanks 15 which fall toward the center and are preferably uniformly arranged on the circumference. Three such flanks are then preferably arranged at an angle of 120° with respect to one another, four such flanks are arranged at an angle of 90° with respect to one another and so on.

If a test tube (not illustrated) is then held in the cavity 12 for vortexing and is pressed on with a gentle pressure force, the accommodating adapter 4 together with the cavity 12 changes to its mixing movement which oscillates in a circular and translatory manner in a horizontal plane and thus puts a liquid in the test tube into a vortex for the purpose of mixing. As soon as the operator reduces the pressure force, the drive (not illustrated) of the mixing apparatus 2 stops automatically. These automatic operations of starting and ending vortexing, which are dependent on the pressure force, are possible, according to the invention, using a sensor which reacts to the pressure force and switches the drive of the mixer 2 on and off. This switching operation may also be controlled with a time delay in order to avoid taking into account inadvertent reduction of the pressure force, for example, and also to avoid switching on the vortexer immediately if it is only inadvertently touched, for example.

On one hand, the accommodating adapter 4 in the form of a frame has, as holding structures 6, 8, three U-shaped spring clasps 8 which have been turned upside down and two of which are arranged centrally symmetrically on the accommodating adapter frame 4 along a longitudinal inner flank and one of which is arranged on a transverse inner flank in such a manner that a resilient limb of each of the spring clasps 8 points into the interior of the frame 4. On the other hand, the accommodating adapter 4 has three elastic abutments 6 which are opposite the clasps 8 and are each in the form of an elastomer cylinder on its two other inner flanks.

If an exchangeable block module (not illustrated) is then introduced into the holder 6, 8 of the accommodating adapter 4 from above, the shape of the inner flanks of the spring clasps 8 and of the elastic abutments 6 passively guides the exchangeable block module into the holder as far as a stop 14. An exchangeable block module which has been introduced is then essentially held there only in a force-fitting and frictional manner and, in particular, not in a form-fitting manner, that is to say preferably without an additional notch or an additional locking element.

This makes the inventive holder particularly suitable for automatic machines—but not least also for daily manual insertion where, despite perhaps occasionally diminishing concentration during positioning, an exchangeable block module having the vessel contents to be mixed must ultimately be inserted into the mixing apparatus in a reliable manner and in an accurate position.

In the case of the holder 6, 8 depicted, the spring clamping means 8 exerts a lateral holding force on an accommodated exchangeable block module (not illustrated), which force elastically pushes the lower edge of the latter into the elastic abutments 6. Although the spring clamping means 8 are not actually form-fitting since they do not have a latching depression in which a lower edge of an exchangeable block module, for example, could engage in a form-fitting manner, pushing the lower edge of an inserted exchangeable block module into the elastic abutment additionally produces a form-fitting connection as it were.

The invention claimed is:

1. An apparatus for mixing laboratory vessel contents, comprising:

an accommodating adapter comprising a frame with spaced-apart sides enclosing an area configured to accommodate an exchangeable block module for holding one or more laboratory vessels, wherein the sides of the frames include one or more holders to hold in place the exchangeable block module during mixing;

a drive configured to put the accommodating adapter into a mixing movement that oscillates in a circular and translatory manner in a horizontal plane; and a vortex adapter that is configured when subjected to a pressure force to drive a laboratory vessel into the mixing movement, wherein the vortex adapter is positioned within the area defined by the sides of the frames and is accessible from outside the apparatus, and wherein the vortex adapter includes a shoulder structure having a circumference and at least one shoulder that points to the center of the circumference.

2. The apparatus of claim 1, wherein the vortex adapter includes a cavity.

3. The apparatus of claim 1, wherein the vortex adapter includes at least three radial flanks that are inclined toward the center of the vortex adapter.

4. The apparatus of claim 1, wherein the vortex adapter includes a surface that can be elastically pushed inward to form a cavity.

5. The apparatus of claim 1, wherein the shoulder structure has an elastic surface.

6. The apparatus of claim 1, wherein the vortex adapter is removable from the accommodating adapter.

7. The apparatus of claim 1, wherein the vortex adapter is part of an upper surface of an exchangeable mat on the accommodating adapter.

8. The apparatus of claim 1, wherein the mixing movement has a frequency of more than 2000 revolutions per minute.

9. The apparatus of claim 1, wherein the mixing movement has a frequency of more than 3000 revolutions per minute.

10. The apparatus of claim 1 wherein the mixing movement has a radius of less than 3 centimeters.

11. The apparatus of claim 1, wherein the mixing movement has a radius of less than 2 centimeters.

12. The apparatus of claim 1, wherein the mixing movement has a frequency and a radius that can be set.

13. The apparatus of claim 1, wherein the exchangeable block module is a microtiter plate.

14. An apparatus for mixing laboratory vessel contents, comprising: an accommodating adapter comprising a frame with spaced-apart sides enclosing an area configured to accommodate an exchangeable block module for holding one or more laboratory vessels, wherein the sides of the frames include one or more holders; and a drive configured to put the accommodating adapter into a mixing movement that oscillates in a circular and translatory manner in a horizontal plane, wherein the frame includes three U-shaped spring clamps which have been turned upside down and two of which are arranged centrally symmetrically on the accommodating adapter frame along a longitudinal inner flank and one of which is arranged on a transverse flank configured to hold the exchangeable block module in a force-fitting and frictional manner.

15. The apparatus of claim 14, wherein the frame is not form-fitting to the exchangeable block module.

16. The apparatus of claim 14, wherein the spring clamps exert a lateral holding force on the exchangeable block module.

17. The apparatus of claim 14 further comprising a guide configured to introduce the exchangeable block module into the frame in a vertical manner from above as far as a stop.

18. The apparatus of claim 14 further comprising at least one elastic abutment, wherein the spring clamps push the exchangeable block module into the abutment.

19. The apparatus of claim 18, wherein the at least one elastic abutment is an elastic tube.

* * * * *